United States Patent [19]

Fay

[11] 4,068,561

[45] Jan. 17, 1978

[54] PRE-DETERMINED PRESSURE SYSTEM

[75] Inventor: Robert C. Fay, Spartanburg, S.C.

[73] Assignee: Milliken Research Corporation, Spartanburg, S.C.

[21] Appl. No.: 651,351

[22] Filed: Jan. 22, 1976

[51] Int. Cl.[2] ..... F15B 13/042; F15B 13/044

[52] U.S. Cl. ..... 91/433; 91/356; 91/451; 100/51

[58] Field of Search ..... 91/451, 318, 356, 433, 91/468, 219, 275; 100/51, 52

[56] References Cited

U.S. PATENT DOCUMENTS

| | | | |
|---|---|---|---|
| 2,757,641 | 8/1956 | Meddock | 91/318 X |
| 2,912,037 | 11/1959 | Rhodes | 100/52 |
| 2,987,886 | 6/1961 | Deering et al. | 91/318 |
| 3,229,618 | 1/1966 | O'Connor, Jr. | 100/52 X |
| 3,336,861 | 8/1967 | Clar | 100/52 X |
| 3,358,563 | 12/1967 | Williams | 91/318 X |
| 3,387,563 | 6/1968 | Williams et al. | 91/318 X |
| 3,869,978 | 3/1975 | Steinberg et al. | 100/51 X |

*Primary Examiner*—Irwin C. Cohen

*Attorney, Agent, or Firm*—Earle R. Marden; H. William Petry

[57] ABSTRACT

System and method to ensure that the pressure in a hydraulic pressure system is at a pre-determined level and is maintained for a pre-determined length of time.

1 Claim, 1 Drawing Figure

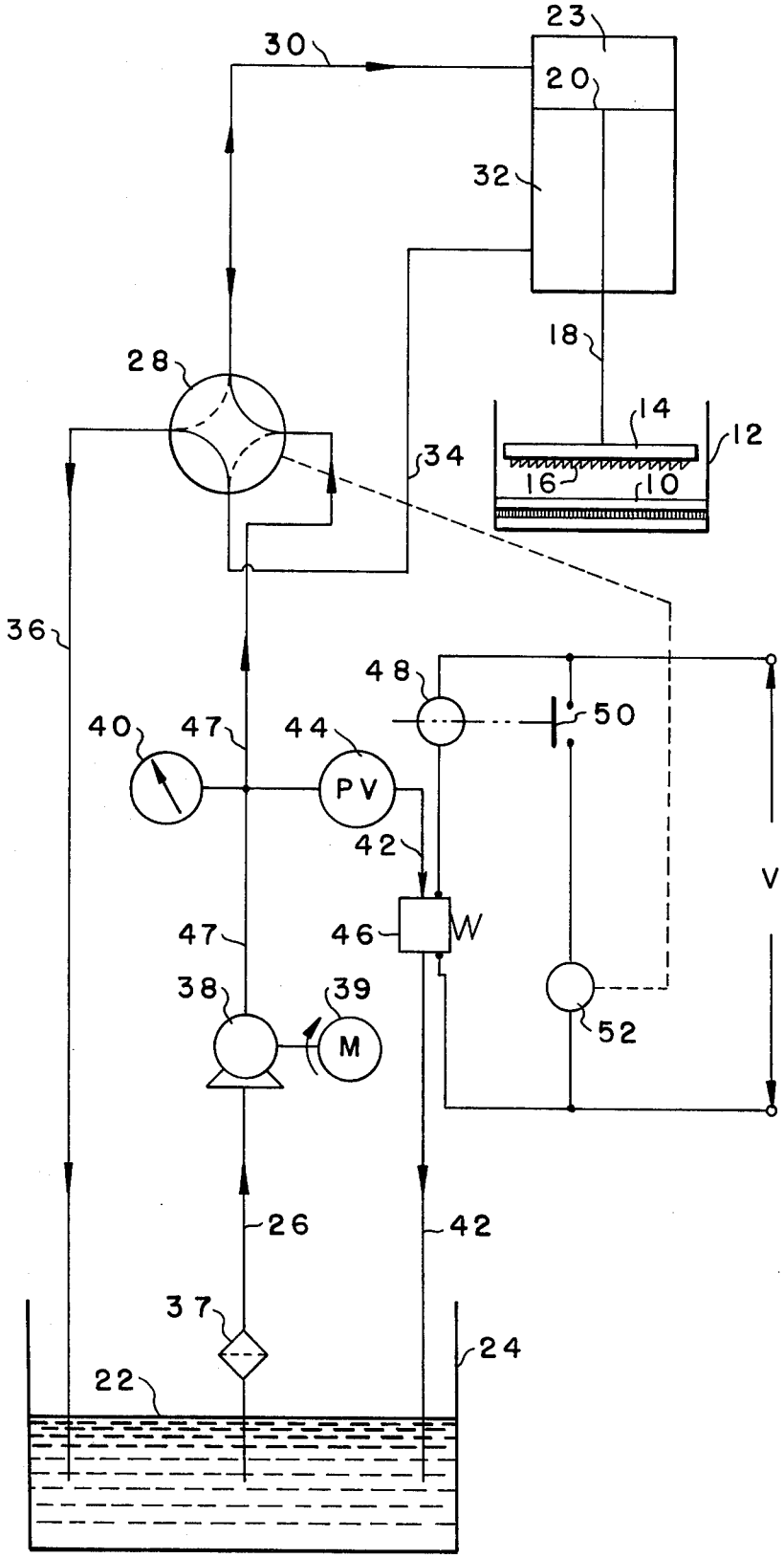
23
30
20
32
18
28
14
12
34
16
10
36
48
50
40
47
44
PV
42
V
47
46
W
38
39
M
52
26
42
37
24
22

PRE-DETERMINED PRESSURE SYSTEM

It is an object of the invention to provide a system and method to ensure the application of a pre-determined pressure to a desired object for a pre-determined length of time to accomplish the desired result.

Other objects and advantages of the invention will become readily apparent as the specification proceeds to describe the invention, in which:

The drawing represents a schematic presentation of the new and novel hydraulic system to emboss a carpet tile 10 mounted in a suitable press 12 which employs a platen 14 with cutters 16 thereon that are forced against the tile by hydraulic pressure exerted against the piston rod 18 mounted in the piston 20.

The hydraulic fluid 22 is supplied to the top 23 of piston 20 from the sump or reservoir 24 via conduit 26 four way valve 28 and conduit 30. Hydraulic fluid is returned to sump from the bottom 32 of the piston via conduit 34, four way valve 28 and conduit 36. The fluid 22 is supplied through a filter 37 to the piston 20 by a conventional pump 38 driven by a motor 39. Located in operative relationship with the outlet side of the pump 38 is a pressure gauge 40. Also connected to the outlet side of the pump is a by-pass conduit 42, flow through which is controlled by a pressure relief valve 44 to allow hydraulic fluid 22 to return to the sump 24 when the pressure in conduit 47 reaches a pre-determined level. Located between the pressure relief valve 44 and the sump 24 in the by-pass conduit 42 is a flow switch 46 for reasons hereinafter explained.

OPERATION

When it is desired to emboss the tile 10, the pump is started and the valve 28 assumes the solid line position so that hydraulic fluid is being pumped from the sump 24 through the conduit 30 into the top of piston 23 while fluid is being returned via conduits 34 and 36 into the sump from the bottom 32 of piston 20. The piston rod 18 will then move downwardly to place the cutters 16 into contact with the tile 10. It is desired that the cutters be maintained in contact with the tile 10 for a pre-determined amount of time at a pre-determined pressure. When the pre-determined pressure is reached in the conduit 47 the pressure relief valve 44 will open by-passing fluid back to the sump 24. When the fluid is by-passed the switch member in the flow switch 46 will make and energize the coil 48 of the time delay relay. The time delay relay, after a pre-determined passage of time, will make switch 50 to energize the solenoid coil 52 of the four way valve 28, as indicated by the dotted line, to reverse the position thereof. When the four way valve 28 is reversed to the dotted line position, hydraulic fluid 22 will be pumped into the bottom 32 of the piston 20 while fluid will be returned to the sump 24 via conduits 30 and 36 from the top of piston 20 to cause the piston rod 18 and attached platen 14 and cutters 16 to raise from the tile 10. The system will then cut off and be ready for the next tile after the embossed tile 10 has been removed.

As can be seen a system has been provided to ensure that a pre-determined pressure has been applied to an object to be worked on for a pre-determined length of time.

Although we have described the specific embodiment of the invention, it is contemplated that changes may be made without departing from the scope or spirit of the invention and it is desired that the invention be limited only by the scope of the claims.

That which is claimed is:

1. A system to apply pressure to an article to be worked on comprising: a piston chamber having a piston head slidably mounted therein, a source of fluid, an electrically operated reversing valve means, a first means to supply fluid from said source through said valve means to one side of said piston head, a second means to return fluid from the other side of said piston head to said source, a third means to return fluid from said first means to said source, a fourth means operably associated with said third means to allow fluid from said first means to flow through said third means only when the pressure of the fluid in said first means is at a pre-determined level and an electrical control circuit including a time delay means operably associated with said valve means and having flow switch means for energizing said time delay means responsive to the flow of fluid in said third means past said fourth means as it returns to said source to allow fluid to flow in said first means for a pre-determined time and then reverse the position of said valve means to reverse the flow of fluid to and from said piston head.

* * * * *